United States Patent [19]

Ellmore, deceased

[11] Patent Number: 4,917,126

[45] Date of Patent: Apr. 17, 1990

[54] STOWABLE CRUTCH

[75] Inventor: Austin Ellmore, deceased, Los Gatos, Calif., Hazel Ellmore, executrix

[73] Assignee: Children's Hospital

[21] Appl. No.: 747,082

[22] Filed: Jun. 19, 1985

[51] Int. Cl.[4] ..... A61H 3/02

[52] U.S. Cl. ..... 135/69; 135/75

[58] Field of Search ..... 135/75, 76, 68, 69, 135/72, 73, 76, 71, 65, 66, 17, 19

[56] References Cited

U.S. PATENT DOCUMENTS

| | | | |
|---|---|---|---|
| 1,192,290 | 7/1916 | Engstrom | 135/69 |
| 2,388,778 | 11/1945 | Wheeler | 135/68 |
| 2,408,604 | 10/1946 | Brickson | 135/74 |
| 2,528,706 | 11/1950 | Osborn | 135/69 |
| 2,590,607 | 3/1952 | Grimball | 135/69 |
| 2,711,183 | 6/1955 | Lofstrand, Jr. | 135/69 |
| 3,208,461 | 9/1965 | Irwin | 135/69 |
| 3,254,659 | 6/1966 | Williams | 135/69 |
| 3,304,946 | 2/1967 | Lutes | 135/69 |
| 3,947,140 | 3/1976 | Thomas | 135/69 X |
| 4,151,853 | 5/1979 | Inbar | 135/72 |

FOREIGN PATENT DOCUMENTS

| | | | |
|---|---|---|---|
| 77604 | 8/1919 | Austria | 135/68 |

*Primary Examiner*—Robert A. Hafer
*Assistant Examiner*—Charles H. Sam
*Attorney, Agent, or Firm*—Townsend & Townsend

[57] ABSTRACT

A stowable crutch is disclosed which includes a body consisting of a first and a second tube secured to each other. A third tube to which a crutch tip is attached is slidably mounted within the first tube and includes a plunger assembly to secure the third tube in any one of a plurality of fixed positions with respect to the first tube. A fourth tube, to which an underarm assembly is secured, is slidably mounted within the second tube and also includes a plunger assembly to secure the fourth tube in a number of desired positions with respect to the second tube. A hand grip is mounted to the body with a ball-and-socket joint to enable adjustment of its orientation with respect to the body.

5 Claims, 2 Drawing Sheets

STOWABLE CRUTCH

BACKGROUND OF THE INVENTION

1. Field of the Invention

This invention relates to aids for a temporarily or permanently disabled individual, and in particular to a crutch which at the option of the user may be stowed into a much more compact form than when in use. In addition, the invention relates to a crutch whose size may be simply and readily adjusted.

2. Description of the Prior Art

Almost everyone is familiar with the crutches of the prior art. Generally, such crutches have two members supporting an underarm piece and pad with a handle disposed between the two members for the user's grip. The two members come together beneath the grip, and from there a single member extends to the ground. Such crutches have several disadvantages. To extend from beneath the user's arm to the ground, such crutches must be on the order of four to five feet in length. Thus, whenever the user of such a crutch is sitting or reclining, the crutch must be leaned against a wall or chair, or otherwise stored. Because of the bulkiness, storage of such crutches is difficult, particularly in confined situations such as while riding in a wheelchair, sitting in an airplane seat, or sitting in a restaurant. Furthermore, such crutches by virtue of their structure may be adjusted only with tools such as wrenches or screw drivers. To make such adjustments, the user must remove two or more bolts in each crutch which secure the single member to the pair of members, readjust the length, and retighten the bolts.

One attempt at making a crutch, which when stored is smaller than when in use, is a crutch manufactured by Husa Company. This type of crutch includes a folding joint at the intersection between the single member and the pair of members to enable the crutch to be folded in half. Although this provides some improvement in stowability, the resulting crutch is still not sufficiently small to fit comfortably in a wheelchair, or to be placed beneath the seat in a commercial airliner.

SUMMARY OF THE INVENTION

This invention provides a crutch whose size may be easily reduced to enable the crutch to fit within a wheelchair or beneath an airplane seat. Additionally, the invention provides a crutch which when compacted may be employed as a cane, and to a crutch whose overall length may be readily adjusted by the user without need of tools. In a preferred embodiment, the crutch includes a body, a crutch tip, an underarm support, a first telescoping means connected to the crutch tip for extending the crutch top downward from the body, and a second telescoping means connected to the underarm support for extending the underarm support upward from the body. Typically, the body will be fabricated from two parallel tubes clamped together, and each of the first and second telescoping means will consist of a tube adapted to slide within the tubes forming the body. A hand grip is provided by a grip whose base is swivelably mounted to the body. In a preferred embodiment, the position of each of the telescoping tubes with respect to the body is secured by spring-loaded plunger assemblies secured within the telescoping tubes and adapted to cause a plunger to engage an opening in the body when the telescoping tube is in a desired position.

IN THE DRAWINGS

DETAILED DESCRIPTION OF THE PREFERRED EMBODIMENT

Figure 1A:
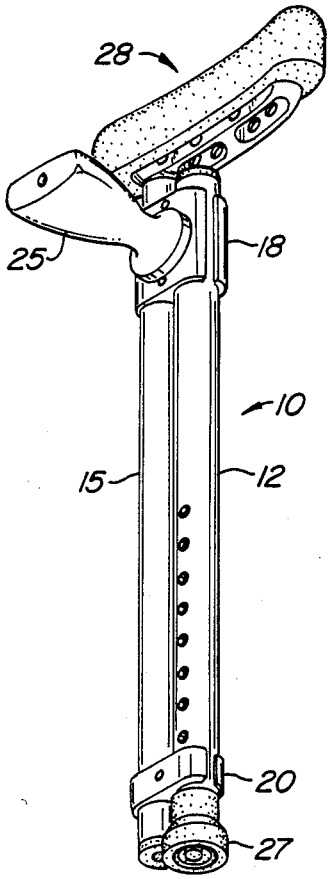
FIG. 1A is a perspective view of a preferred embodiment of the stowable crutch illustrating its appearance when fully collapsed to its most compact form.

FIG. 1A is a perspective view of a preferred embodiment of the stowable crutch. FIG. 1A depicts the stowable crutch in the form in which it will fit beneath a chair, i.e., fully retracted. As shown in FIG. 1A, the crutch includes a body 10 generally consisting of first 12 and second 15 aluminum tubes secured together. Tubes 12 and 15 are secured together by clamps 18 and 20. Clamp 18 is positioned at the upper end of the body, while clamp 20 is positioned at the lower end. A hand grip 25 is mounted to the upper clamp 18 in a manner which will be described below. A crutch tip 27 is mounted on a first telescoping tube (not shown in FIG. 1A), while an underarm support assembly 28 is mounted on a second telescoping tube (also not shown in FIG. 1A).

Figure 1B:
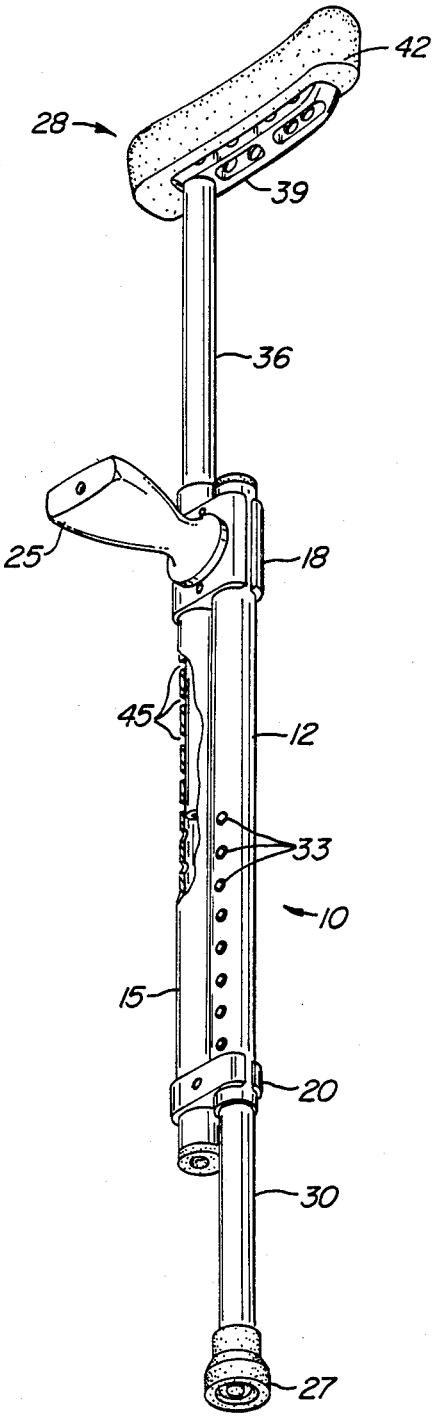
FIG. 1B is a perspective view illustrating the appearance of the stowable crutch when partially extended in a form such as a user might employ it.

FIG. 1B depicts the crutch in an extended position in a form as a user would employ it as a crutch. As shown there, the crutch tip 27 has been extended from body 10 by virtue of a first telescoping tube 30. Tube 30 has an outside diameter very slightly smaller than the inside diameter of tube 12 to enable tube 30 to slide within tube 12. Tube 30 includes a plunger assembly which is not shown in FIG. 1B, but will be discussed in conjunction with FIG. 2, which enables tube 30 to be secured in any one of a number of fixed positions with respect to tube 12. This is achieved by allowing the plunger of the plunger assembly to engage one of a series of openings 33 in tube 12. When the plunger of the plunger assembly engages a desired one of openings 33, the plunger extends outward from the inner tube 30 through the opening 33 to lock tube 30 in position with respect to tube 12.

In a similar manner, a second movable tube 36 slides within tube 15 of body 10. At the upper end of tube 36 is an axillary support 39 over which a resilient underarm pad 42 is secured. Movable inner tube 36 also includes a plunger assembly (not shown) to allow it to engage a series of openings 45 in tube 15. Thus, tube 36 may be locked in position with respect to tube 15. The ease with which tubes 36 may be retracted and extended to their desired positions enables easy modification of the exterior dimensions of the crutch, thereby enabling it to be compacted to fit in small areas, yet be quickly extended to suit the physical dimensions of the individual using it.

To employ the crutch as a cane, the user retracts either or both of the tubes 30 and 36 to lower the underarm assembly to a height suitable for supporting a user's hand. The user then grasps assembly 28 with one hand and allows the crutch tip 27 to contact the ground. Alternatively, the user may grasp hand grip 25, and may even completely remove tube 36 and the attached underarm support assembly 28. As so used, the semi-compacted assembly will steady the individual while walking.

Figure 2:
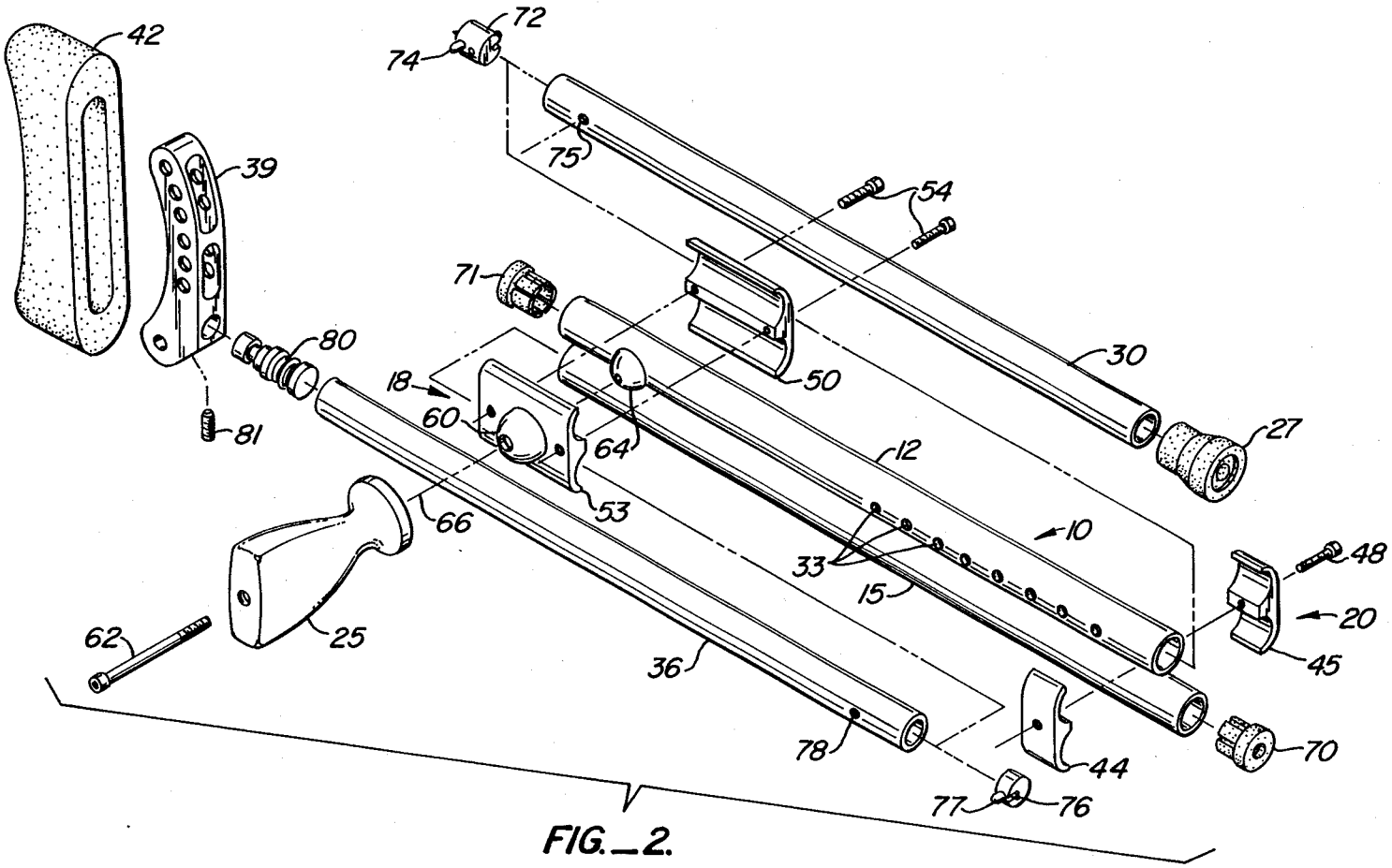
FIG. 2 is an exploded view of the stowable crutch illustrating the manner of its construction.

FIG. 2 is an exploded view illustrating the manner of fabrication of a preferred embodiment of the stowable crutch of this invention. As shown in FIG. 2, the body 10 of the crutch consists of two outer tubes 12 and 15 generally secured in a fixed position with respect to each other by virtue of clamps 18 and 20. Clamp 20 itself consists of an outer clamp plate 44 and an inner clamp plate 45. Each of the clamp plates 44 and 45 includes a generally smoothly contoured exterior surface and a pair of contoured inner curved surfaces adapted to closely fit the exterior diameter of the tubes 12 and 15 of body 10. By securing clamp plates 44 and 45 together, for example using a screw 48, tubes 12 and 15 are held tightly in fixed alignment with respect to each other. In a similar manner, upper clamp 18 consists of an inner clamp plate 50 and an outer clamp plate 53. The upper clamp plates are held together and around the exterior surfaces of the tubes 12 and 15 by two screws 54.

A unique feature of the stowable crutch is its ability to permit adjustment of the position of the hand grip 25 with respect to the orientation of body 10. This is made possible by the ball-and-socket joint by which grip 25 is attached to clamp plate 53. Formed in the base of grip 25 is a smoothly contoured surface of substantially the same dimensions as the ball swivel 60 formed on clamp plate 53. A bolt 62 extends through grip 25, and through the opening in ball swivel 60 to threadably engage "ball" 64 behind clamp plate 53. This enables adjustment of the orientation of grip 25 with respect to body 10. In the preferred embodiment grip 25 may be moved within a cone defined by an angle of up to 10° from axis 66.

End caps 70 and 71 are inserted into the unused open ends of tubes 12 and 15. Caps 70 and 71 seal the ends of these tubes to keep foreign objects out of the tubes which might interfere with the operation of the telescoping tubes 30 and 36.

Telescoping tube 30 slides within body tube 12. A commercially-available crutch tip 27, typically fabricated from rubber or other resilient material, slides over the lower end of tube 30 to provide the user of the crutch with a non-slip tip. At the other end of tube 30 a spring-loaded plunger assembly 72 is inserted. Assembly 72 fits within tube 30 and has a plunger 74 which is spring-loaded to protrude outward from assembly 72. Once inserted into tube 30, plunger 74 is allowed to protrude through opening 75. When tube 30 is in an extended position with respect to tube 12, plunger 74 will extend through opening 75 into a desired one of the openings 33 in tube 12. In this manner, tube 30 is locked in a secure position with respect to tube 12. The plurality of holes 33 enables the user of the crutch to extend the tube 30 and crutch tip 27 to a desired length suitable for that individual's physical dimensions. In a fully-retracted position (such as that depicted in FIG. 1A), plunger 74 may engage another opening (not shown) at the upper end of tube 12 to prevent tube 30 from inadvertently being extended from tube 12.

In a similar manner tube 36, which slides within tube 15 to extend the underarm support away from the body 10, also includes a plunger assembly 76 having a plunger 77. Assembly 76 is inserted within tube 36 to allow plunger 77 to protrude through opening 78. Tube 36 then may be secured in a retracted position with respect to tube 12 by allowing plunger 77 to protrude through a suitably placed opening (not shown) in tube 15. Tube 36 may be secured in an extended position with respect to tube 15 by allowing the plunger 77 to engage a desired one of a plurality of openings (not shown) in tube 15. (These openings 45 are shown in cross-section in FIG. 1B.)

At the upper end of tube 36, a post 80 is secured within tube 36, for example, using a suitable adhesive or mechanical fixture. In the secured position, a portion of post 80 protrudes from the upper end of tube 36 to allow a set screw 81 to secure axillary support 39 to the upper end of post 80, and thereby secure support 39 to tube 36. The use of a set screw allows the axillary support 39 to be swiveled to a desired position by the user. Once in that position, the screw 81 may be tightened to lock the support 39 in the desired position. To minimize weight, support 39 has been drilled out. A resilient underarm pad 42, also commercially available, fit over (axillary) auxiliary support and provides a cushion between the underarm of the user and the axillary support 39.

Although the foregoing has been a description of the preferred embodiment of the invention, it should be understood that many details have been provided to fully explain the invention. The scope of the invention may be ascertained from the appended claims.

I claim:

1. A stowable crutch comprising:

a body consisting of first and second tubular members of substantially the same length nonadjustably affixed to each other and each having a longitudinal axis disposed parallel to and spaced-apart from the other;

a first telescoping member adapted to slide within the first tubular member and having a first end portion extendable from the body, wherein said first telescoping member has a length substantially equal to said body length;

a crutch tip affixed to the first end portion;

a second telescoping member adapted to slide within the second tubular member and having a second end portion extendable from the body in a direction opposite the first end portion, wherein said second telescoping member has a length substantially equal to said body length; and an underarm portion affixed to the second end portion.

2. A stowable crutch as in claim 1 further comprising:

spring biased latching means coupled to the body for temporarily securing each of the first and second telescoping means at desired positions with respect to the body.

3. A stowable crutch as in claim 1 further comprising:

a hand grip secured to the body.

4. A stowable crutch as in claim 1 wherein each of the first and second telescoping members comprises a tube.

5. A stowable crutch as in claim 2 wherein the spring-biased latching means comprises a first latch disposed to adjustably secure the first telescoping member to the first tubular member and a second latch disposed to adjustably secure the second telescoping member to the second tubular member.

* * * * *